United States Patent [19]

Santucci

[11] 3,951,177

[45] Apr. 20, 1976

[54] DEVICES FOR FOLDING INTO THE WARP SHED BOTH ENDS OF A WEFT THREAD IN A FABRIC MADE BY A SHUTTLELESS LOOM HAVING A CONTINUOUS WEFT SUPPLY MECHANISM

[75] Inventor: Nicola Santucci, Schio, Italy

[73] Assignee: Nuovo Pignone S.p.A., Florence, Italy

[22] Filed: Nov. 6, 1974

[21] Appl. No.: 521,527

[30] Foreign Application Priority Data

Nov. 6, 1973 Italy ..... 30955/73

[52] U.S. Cl. ..... 139/431; 139/453

[51] Int. Cl.[2] ..... D03D 47/48; D03D 47/38

[58] Field of Search..... 139/122 S, 122 W, 122 R, 139/126 R, 127 R

[56] References Cited

UNITED STATES PATENTS

| | | | |
|---|---|---|---|
| 3,340,902 | 9/1967 | Berry | 139/122 S |
| 3,425,461 | 2/1969 | Berry | 139/122 S |
| 3,444,900 | 5/1949 | Schapper | 139/122 W |
| 3,548,886 | 12/1970 | Scherillo | 139/122 W |
| 3,613,741 | 10/1971 | Ravella | 139/122 W |
| 3,727,647 | 4/1973 | Laval | 139/122 W |

FOREIGN PATENTS OR APPLICATIONS

| | | | |
|---|---|---|---|
| 46-33755 | 10/1971 | Japan | 139/122 S |
| 76,147 | 8/1961 | France | 139/122 W |

*Primary Examiner*—James KeeChi
*Attorney, Agent, or Firm*—Ralph M. Watson

[57] ABSTRACT

Means are provided for entraining the free ends of weft threads extending from a formed fabric in movable suction hoses at each side of the loom. The hoses manipulate the weft thread ends into a position adjacent the sheds where hooked needles engage and fold the ends into the shed prior to beating. The weft threads on the side of the fabric which are attached to bobbins are folded into the sheds according to the pick repeat of the loom and the threads on the opposite side are folded into the next shed.

5 Claims, 13 Drawing Figures

DEVICES FOR FOLDING INTO THE WARP SHED BOTH ENDS OF A WEFT THREAD IN A FABRIC MADE BY A SHUTTLELESS LOOM HAVING A CONTINUOUS WEFT SUPPLY MECHANISM

The present invention relates to a process and relevant devices for folding into the warp shed both ends of a weft thread in a fabric made by a shuttleless loom having a continuous weft-supply mechanism wherein the differing weft threads to be woven, come from fixed bobbins mounted outside the fabric, remain all attached to the edge of the same fabric and are cut only when they have to be brought once again into the shed by inserting and retraction needles running in opposite directions on the sley of the same loom.

Some prior art processes are already known for folding into the warp shed the ends of the weft threads extending outside the shed into the warp shed so as to form a characteristic fringe. These processes make substantially use of mechanisms which are synchronized to the movement of the sley and conveying needles, and move hooked needles which grips the ends of the weft threads to be folded. But all the known processes cannot be utilized for a loom of the above-said type wherein all the weft threads to be woven remain attached to the fabric and are brought into the shed while the sley is moving. These weft threads, which come from the fixed bobbins and remain attached to the edge of the fabric, interlace, in fact, to each other in a mingling of threads wherein the cut end of the selected weft thread to be woven remains entangled. This makes the release and the gripping of said end difficult, because these operations are necessary for an effective folding of said end into the warp shed.

On the other hand, since the weft threads are brought into the shed while the sley is moving, the devices for folding the ends of said weft threads into the warp shed are required to be provided with movements which are coordinated with the movements of the sley and to be able to act on weft threads, which are in movement too.

An object of the present invention is to solve the above said problems and to provide a process and the relevant devices for folding both ends of a weft thread in a fabric into the warp shed made by a shuttleless loom having a continuous weft-supply mechanism.

According to the present invention the folding of the ends of the weft threads into the shed is obtained in a different way on the two sides of the fabric. More precisely, on the side where the weft threads to be woven remain attached to the formed fabric, the cut ends of the inserted weft threads are folded into the same warp sheds in which corresponding weft threads are inserted the next time according to the pick repeat in the weaving design of the weft-thread selecting mechanism. Thus a characteristic "bridle"-shaped selvedge is formed whose length varies according to the pick repeat in the weaving design of the weft-thread selecting mechanism. On the other side of the fabric the ends of the inserted weft threads are on the contrary always folded into the next shed, and the folding does not depend on the pick repeat in the weaving design of the weft-thread selecting mechanism.

The process for folding the ends of a weft thread into the warp shed is characterized, according to the present invention, in that, on the side of the fabirc where the weft threads are attached to the edge of the same fabric, the cut weft end of the selected weft thread is released from the mingling of the other weft threads and retained by a moving pneumatic suction hose. The hose extends from a device installed on the loom's breast beam, and the hose performs a movement of rotation and translation in a plane perpendicular to the plane of the formed fabric and parallel to the warp threads. The cut end is folded into the warp shed, while the sley is beating the weft thread into the fabric, by a hooked needle of the device which also moves according to a movement of rotation and translation in a plane inclined towards the sley as to the said plane of the formed fabric on the other side of the fabric, the weft end of the selected weft thread brought outside the shed by the retraction needle is grasped and tensioned by another pneumatic suction hose mounted on the sley after the weft thread has been beaten into the fabric, it is grasped by a mechanical clamping system provided with pliers of a second device installed on the loom's breast beam. This system performs a movement of rotation and translation in a plane perpendicular to the plane of the formed fabric and parallel to the warp threads, and said weft end is then suitably cut by the shears of the second device. The exceeding part of the weft end is sucked by the said other pneumatic suction hose, and successively it is gripped and folded into the next shed by another hooked needle of the said second device. This needle performs a movement symmetrical to the movement of the said hooked needle of the first device.

The adoption, according to the invention, of a moving, pneumatic suction hose assures that the cut end of the weft thread always remains well strained during the whole folding operation, which permits a perfect selvedge. The movement of rotation and translation of the suction hose serves to move the latter forwardly to the cutting zone, upwardly in order to let the hose creep against the mingling of the weft threads to facilitate the release of the weft end to be gripped, and to bring the hose into close contact with said weft end so as to increase the suction action of said hose, and backwardly and downwardly, respectively, to facilitate the hooking of the said weft end to the said hooked needle and to follow the movement of the sley to allow the reed to beat the weft thread into the fabric.

The adoption, according to the invention, of a mechanic clamping system provided with pliers moving according to a movement of rotation and translation in a plane perperdincular to the plane of the formed fabric and parallel to the warp threads serves on the contrary to facilitate the hooking of the weft end by the hooked needle and to keep said weft end well strained to allow the latter to be suitably cut by the said shears. The cutting operation is necessary to equalize the length of the weft ends which are never of the same length due to slippage of the weft threads during their exchange at the center of the shed from the inserting needle to the retraction needle, and to a possible difference in size of the inserted weft threads.

Finally the movement of rotation and translation of the hooked needles in an inclined plane serves to move the hooked needle forwardly, i.e. towards the reed, and downwardly for inserting it into the shed at a certain distance relative to the fell of the fabric to avoid the hooked needle coming out from the shed, to cut off the warp threads or to enter the formed fabric, and to let the hooked needle come out laterally from the said shed as well as to move it backwardly and successively to bring it again to its starting position so as to make easy the hooking operation of the weft end in cooperation with the already said movements of the moving pneumatic suction hose and of the mechanical clamping system provided with pliers, respectively.

According to an embodiment of the present invention the mechanism for moving the pneumatic suction hose includes a hollow lever which supports the moving pneumatic suction hose at one end and is pivotally connected at the other end to a driving lever. This lever is operated by a cam, a second L-shaped driving lever operated by a cam connected to the hollow lever by a sliding block, which is pivotally connected to one end of the L-shaped driving lever and may slide inside a slit of the hollow lever. The contact between the driving levers and the relevant cams is maintained by springs.

According to another embodiment of the present invention, the mechanism for moving the mechanical clamping system provided with pliers includes a hollow lever, which supports the mechanical clamping system provided with pliers at one end and is pivotally connected at the other end to a driving lever. This lever is operated by a cam, a second L-shaped driving lever operated by a cam connected to the hollow lever by a sliding block, which is pivotally connected to one end of the L-shaped driving lever, and may slide inside the slit of the hollow lever. The contact between the driving levers and the relevant cams is maintained by springs and the mechanical clamping system provided with pliers is hung in its opened, rest position to an adjustable supporting hook protruding out of the box of the same device.

According to a further embodiment of the invention the mechanism for moving the hooked needles includes a control rod which carries the hooked needle adjustable as to the position in the direction of the same rod which is slidably supported in a downwardly inclined direction towards the reed by a substantially T-shaped horizontal lever. This lever is pivoted at the end of its central stem: said rod being connected to a second, horizontal lever pivoted at its end opposed to the T-shaped lever by means of a block which is fixed to said rod and enters a groove of the other end of the said horizontal lever. Each of the horizontal levers are operated through an adjustable stay rod, by a driving bell-crank lever acting in a vertical plane and moved by a conjugate cam.

According to a further embodiment of the invention, the mechanism used in folding both ends of a weft thread into the warp shed are all provided with adjusting elements which permit the action point of the various mechanisms to be varied according to the type of the woven yarn.

The invention will be now illustrated in the accompanying drawings which are merely exemplary and non-limiting embodiments, in that the adoption of constructional techniques or equivalent members different from those suggested herein lies within the scope of the present invention. In said drawings.

Figure 1:
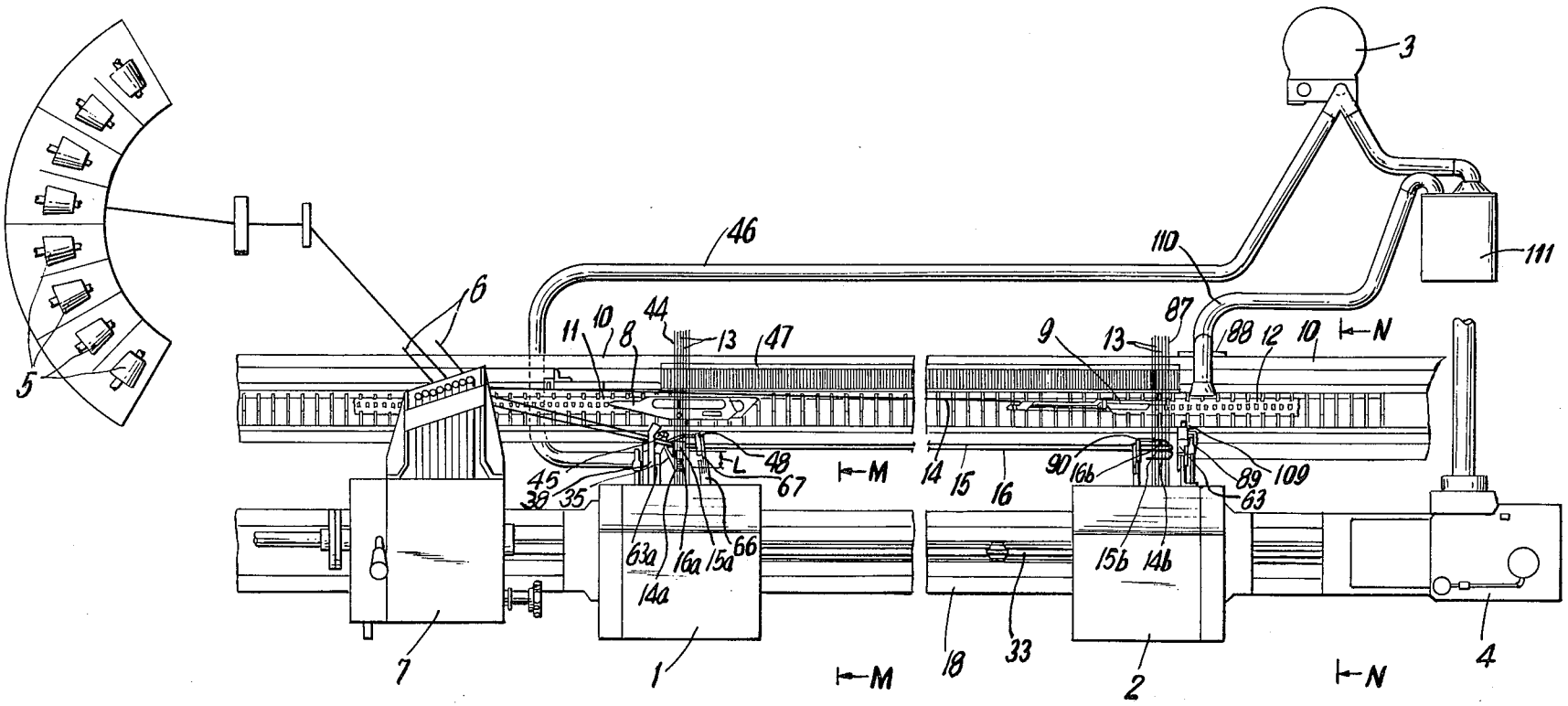
FIG. 1 shows in a top view all the devices of the loom, which are used according to the invention in folding both ends of a weft thread into the shed as well as the way according to which said folding is obtained on the left-hand side and on the right-hand side respectively of the formed fabric.
Figure 2:
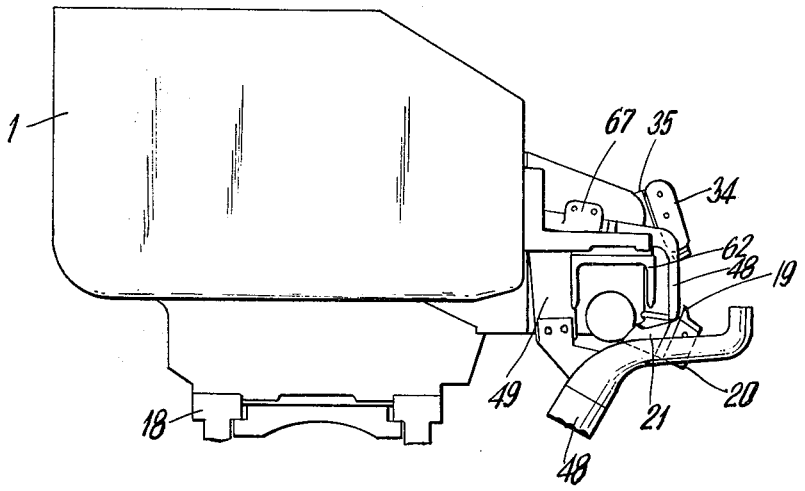
FIG. 2 shows in a front view made according to arrows MM on FIG. 1 the device for folding the ends of the weft threads on the left-hand side of the formed fabric, according to the invention.

Referring to drawings and particularly to FIG. 1, reference numeral 1 indicates the device according to the invention for folding into the shed the ends of the weft threads on the left-hand side of the formed fabric. Reference numeral 2 indicates the device according to the invention to, for folding into the shed the ends of the weft threads on the right-hand side of the formed fabric. Reference numeral 3 indicates the pneumatic system for grasping the ends of the weft threads to be folded into the shed. Reference numeral 4 indicates the driving device for operating devices 1 and 2. Reference numeral 5 indicates the fixed bobbins, mounted outside the fabric, which supply the weft threads 6 to be woven, said threads remaining attached to the edge of the fabric. Reference numeral 7 indicates the device for selecting and presenting the weft threads 6. Reference numerals 8 and 9 indicate the inserting needle and the retraction needle respectively, i.e. the weft thread carrying elements which slide on the loom sley 10 by means of carrying systems 11 and 12 and serve to insert the weft threads inside the shed formed by the warp threads 13. Reference numerals 14, 15 and 16 indicate the weft threads illustrating the way according to which the folding into the shed of the ends of said weft threads is made. And particularly reference numerals **14*a*, 15*a* and 16*a* indicate the ends of the weft threads on the left-hand side of the fabric, while reference numerals 14*b*, 15*b* and 16*b*** indicate the ends of the weft threads on the right-hand side of the fabric.

As it is well visible in FIG. 1, the folding into the length of the ends of the weft threads is accomplished according to the invention in a different way on the two sides of the fabric. On the left-hand side of the fabric where the weft threads to be woven remain attached to the edge of the fabric, the weft ends 14*a*, 15*a*, 16*a* are folded into the same shed wherein the corresponding weft threads 14, 15, 16, are inserted the next time according to the pick repeat in the weaving design of the weft-thread selecting mechanism, so that characteristic bridle-shaped selvedges are formed. The length L of the bridles (in FIG. 1 there is shown the length L of the bridle formed by weft end 16*a*) will vary hence according to the pick repeat in the weaving design of the weft-thread selecting mechanism. On the right-hand side of the fabric the weft ends 14*b*, 15*b* and 16*b* are on the contrary always folded into the next shed and the folding does not depend hence on the pick repeat in the weaving design of the weft-thread selecting mechanism.

The folding into the shed of the weft ends 14*a*, 15*a* and 16*a* on the left-hand side of the fabric is performed by device 1 comprising a box 17 (see FIG. 1 to 7) which is rigidly fixed on the left-hand side of the loom breast beam 18 and houses the mechanisms operating the knives 20 and 34, the suction hose 45 and the hooked needle 48, respectively. On the said left-hand side of the fabric the weft threads to be woven, coming from the fixed bobbins 5, remain all attached to the edge of the same fabric by passing through a suitable opening between the two knives 20 and 34. When a weft thread 14 has to be inserted, this thread is presented by a selecting and presenting device 7 so as already described in Italian patent specification 806,155 (corresponding to U.S. Pat No. 3,548,886) in front of the inserting needle 8 which grasps and draws said thread into the warp shed while the lower knife 20 lifts. Since weft thread 14 is still attached to the edge of the formed fabric, said thread is hence obliged to rotate around an ear 19 (see specifically FIGS. 1 and 4) of the lower knife 20 which, mounted on a lever 21 rotating about a pin 22, has been lifted. The movement to the knife 20 and hence to the lever 21 is provided by a pin 23 which may slide into a groove 24 of lever 21 and is fixed to a crank lever 25 fulcrumed on the pin 26 supported by box 17. The movement to bell-crank lever 25 is provided at its turn by a lever 28 which is pivoted on a pin 29 supported by box 17 and connected to lever 25 by means of an adjustable stay rod 27. On lever 28 there is then mounted a roller 30 which is pressed by a spring 39 against the driving cam 31 keyed on a shaft 32 moved by the driving shaft 33 coming out of the driving device 4.

The weft thread 14 is cut when there is the crossing between the lower knife 20 and the upper knife 34 which, mounted on a bell-crank lever 35 rotating about the said pin 22, is lowered. The movement to upper knife 34 and hence to bell-crank lever 35 is provided by a lever 36 which is pivoted on a pin 37 supported by box 17 and connected to lever 35 by means of an adjustable stay rod 38. At its turn lever 36 carries a roller 40 which is pressed by a spring 41 against a driving cam 42 keyed on a shaft 43 moved by the said driving shaft 33 coming out of the driving device 4. After weft thread 14 has been cut, from the left edge of the formed fabric there is protruding the weft end 14*a* which is to be folded in the same warp shed, formed by the warp threads 13, wherein the weft thread 14 is inserted by being drawn to the center of the shed by the inserting needle 8 and then, after the exchange, by the retraction needle 9.

The position of said ear 19 of the lower knife 20 relative to the first warp thread 44 on the left-hand side of the fabric determines the length of the cut weft end 14*a* to be folded into the shed and hence the width of the formed selvedge.

Figure 5:
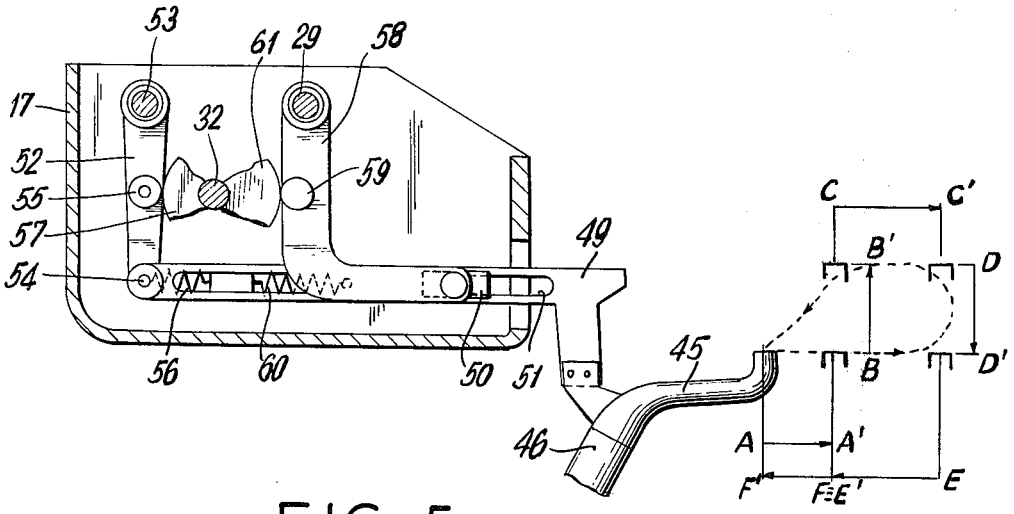
FIG. 5 is a sectioned front view made according to arrows BB on FIG. 3 of the device operating the moving pneumatic suction hose according the invention, the movements of said hose being also shown.

The weft end 14*a* is released from the mingling of the other weft threads 6 remaining attached to the fabric, and retained outside the shed by a moving pneumatic hose 45 connected to the pneumatic system 3 by means of a pipe 46. Hose 45, during the time necessary to insert the weft thread 14 into the shed and to beat with the reed 47 said thread against the fell of the fabric, performs a movement of rotation and translation in a plane perpendicular to the one of the formed fabric and parallel to the warp threads 13. This movement of rotation and translation of the hose, together with the movement of rotation and translation in an inclined plane as to the said plane of the formed fabric of the hooked needle 48, facilitates the hooking of the weft end 14*a* to the hooked needle 48. In FIG. 5 there is shown the whole movement of the suction hose 45, which is the resultant of the simple movements described by vectors $\overline{AA'}$, $\overline{BB'}$, $\overline{CC'}$, $\overline{DD'}$, $\overline{EE'}$, and $\overline{FF'}$. The movements according to vectors $\overline{AA'}$, $\overline{CC'}$, $\overline{EE'}$, and $\overline{FF'}$ are given to the suction hose 45 by a hollow lever 49 (see FIGS. 3 and 5) which supports at one end the said hose 45, is slidably supported by a sliding block 50 being able to slide inside the slit 51 of said lever, and is connected at its other end by mean of a pin 54 to a driving lever 52 which is fulcrumed on a shaft 53 supported by the box 17 and presents a roller 55 pressed by a spring 56 against a driving cam 57 keyed on the already cited shaft 32 operated by the driving shaft 33. The movements according to vectors $\overline{BB'}$ and $\overline{DD'}$ are on the contrary given to the suction hose 45 by the said hollow lever 49 operated by a L-shaped driving lever 58 which is fulcrumed on the said pin 29, presents its other end pivotally connected to the said sliding block 50 and is operated by a driving cam 61 keyed on the said shaft 32, the contact between the lever and the cam being assured by a roller 59 and a spring 60. By means of the forward and upward movements according to vectors $\overline{AA'}$ $\overline{BB'}$ and $\overline{CC'}$ the suction hose 45 is brought, in the zone where the weft end 14*a* has been cut, into contact with the said mingling of the weft threads 6 so as to creep against the said weft threads and to make easy in such a way the opening of the same mingling and hence the release of the weft end 14*a* which gets entangled sometimes according to the order of presentation of the various weft threads, and as much as possible near said weft end 14*a* so as to increase its suction action and to assure a more sure grasping and tensioning of said weft end.

When the suction hose has performed the above said forward and upward movements, the hooked needle 48 begins its movement of rotation and translation in a plane inclined towards the sley as to the plane of the formed fabric. More precisely (see specifically FIGS. 1 and 3) the hooked needle 48 begins to forwardly move towards the reed 47 and downwardly by remaining at first over the warp threads 13 and entering then the warp shed at a certain distance from the beaten fell of the formed fabric; it rotates then counterclockwise for letting its hooked end part 63 come out laterally from the warp shed and finally it returns lightly towards the template cover 62 so that it describes a movement such as shown by marked line 64 in FIG. 3.

Figure 3:
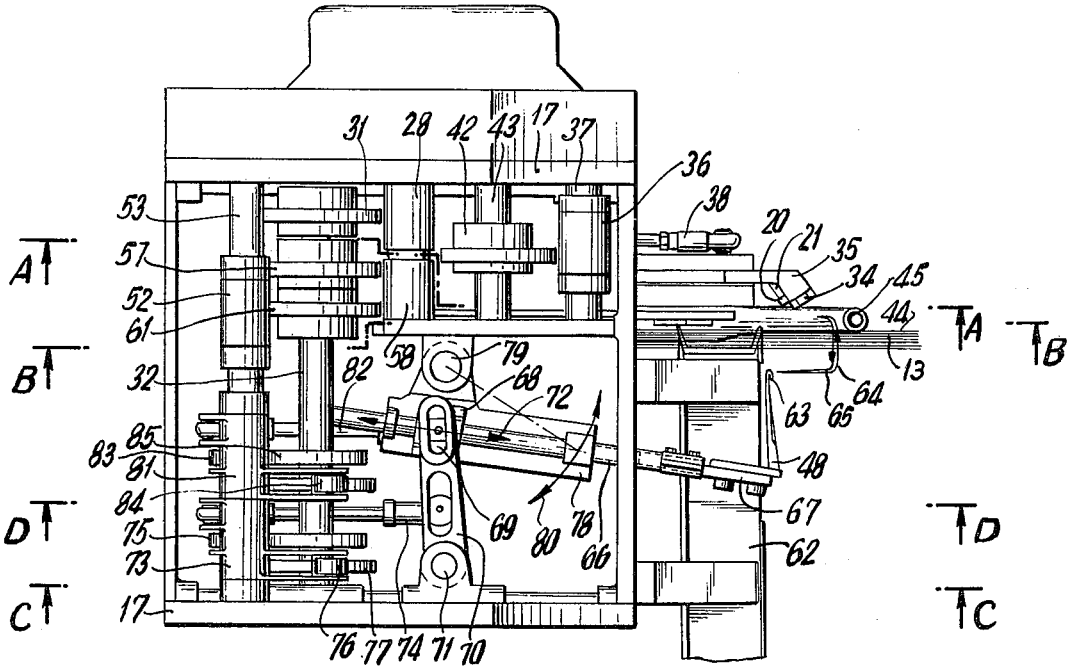
FIG. 3 is a sectioned top view of the device of FIG. 2, wherein there are shown the movements of the left hooked needle according to the invention.
Figure 4:
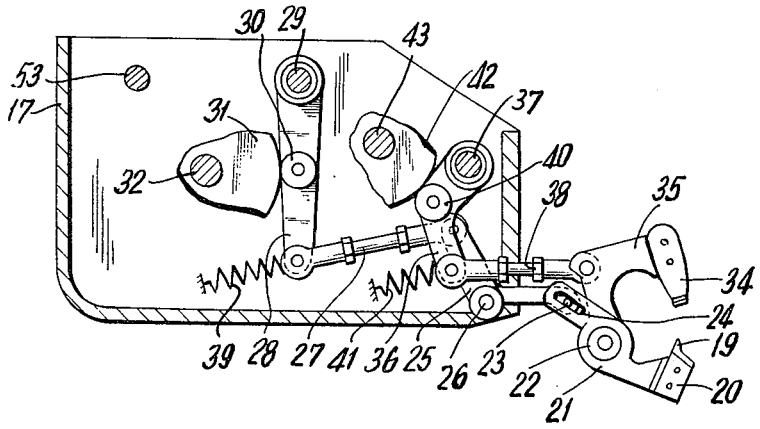
FIG. 4 is a sectioned front view made according to arrows AA on FIG. 3 of the cutting device in the present invention.

Successively, after having grasped the weft end 14*a* to be folded, the hooked needle 48 returns in its starting position by performing the movement shown by line 65 in FIG. 3, i.e. it re-enters the warp shed whose warp threads 13 are closing, and then comes out from the upper threads of the same warp shed. In such a way the weft end 14*a* comes out of the hooked needle 63 and remains inserted between the warp threads when reed 47 beats the weft thread 14.

The device providing the hooked needle 48 with the said movements comprises a control rod 66 (see FIG. 1, 3, 6 and 7) to one end of which the hooked needle 48 is rigidly fixed by means of a connecting element 47 allowing to adjust the position of the said hooked needle along the said rod. Control rod 66 is then supported downwardly inclined towards the reed 47 (see FIG. 7) and only slidable along the direction 72 (see FIG. 3) by a substantially T-shaped horizontal lever 78 pivoted at the end of its central stem on the pin 79 supported by the box 17. The horizontal lever 78 and consequently the hooked needle 48 may then rotate about pin 79 according to an arc of circle 80 (see FIG. 3), said movement being transmitted to lever 78 by a conjugate cam 85 (see specifically FIG. 7) which is keyed on shaft 32 and acts on the rollers 83 and 84 of a bell-crank lever 81 fulcrumed vertically on the shaft 53 and connected to the horizontal lever 78 by means of an adjustable stay rod 82. The sliding of control rod 66 in direction 72 is on the contrary obtained by means of the horizontal lever 70 which is fulcrumed at one of its ends on the pin 71 supported by box 17 and presents at its other end a groove 69 wherein there is slidably inserted a block 68 fixed to the control rod 66, the said horizontal lever 70 being rotated about the pin 71 by a conjugate cam 77 (see specifically FIG. 6) keyed on the already said shaft 32 and acting on the rollers 75 and 76 of a bell-crank lever 73 which is at its turn keyed vertically on the already said shaft 53 and connected to the said horizontal lever 70 by means of an adjustable stay rod 74.

It is to keep in mind that, when the hooked needle 84 performs the movements shown by lines 64 and 65 in FIG. 3, the suction hose 45 performs the already cited downwardly and backwardly movements according to vectors $\overline{DD'}$ and $\overline{EE'}$ (see FIG. 5), which facilitates the hooking of the weft end 14*a* to the hooked needle 84 and allows the weft end 14*a* always to be well strained during the whole folding operation and to obtain hence a perfect selvedge. Successively, the suction hose 45 returns in its starting position, by performing the movement according to vector $\overline{FF'}$, in order to leave the zone where the fabric is woven so as to allow the reed 47 to beat the weft thread.

On the right-hand side of the formed fabric the weft ends 14*b*, 15*b*, 16*b* are on the contrary, as already said, always folded into the next shed as to the one wherein the corresponding weft threads are inserted, by means of a pneumatic suction hose 88 fixed on the sley 10 and of a device 2 comprising a box 86 (see FIGS. 1 and 8 to 13) which is rigidly fixed on the right-hand side of the loom breast beam 18 and houses the mechanism operating the mechanic clamping system 89 provided with pliers, the shears 109 and the hooked needle 90.

When a weft thread, e.g. weft thread 15, has been carried by retraction needle 9 outside the warp shed formed by the warp threads 13 (see FIG. 1), and weft thread is released from the said retraction needle and its weft end 15*b* coming out of the fabric edge coinciding with the last warp thread 87, is sucked and tensioned by the suction hose 88 connected to the suction pneumatic system 3 and fixed on the loom sley 10.

Hose 88 retains the said weft end 15*b* till the inserted weft thread 15 has been beated by reed 47, when there is the intervention of the mechanic clamping system 89 provided with pliers of the device 2, which performs a movement of rotation and translation in a plane perpendicular to the one of the formed fabric and parallel to the warp threads 13, by means of which said system grasps the weft end 15*b* and makes easy the hooking of said weft end to the hooked needle 90 having to insert it into the new formed shed.

Figure 12:
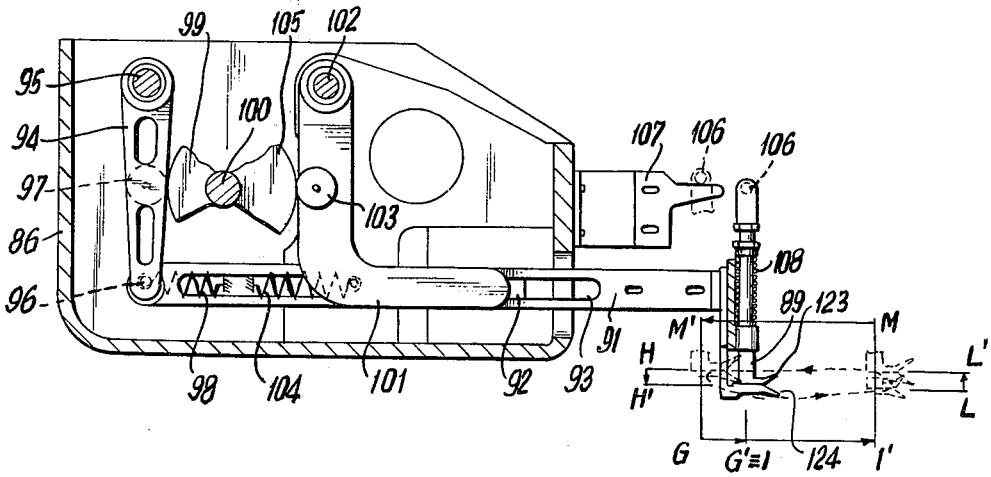
FIG. 12 is a sectioned front view made according to arrows EE on FIG. 9 of the device operating the mechanic clamping system provided with pliers according to the invention, wherein there are also shown the movements of said system.

In FIG. 12 there is shown the whole movement of the clamping system 89, which is the resultant of the simple movements described by vectors $\overline{GG'}$, $\overline{HH'}$, $\overline{II'}$, $\overline{LL'}$ and $\overline{MM'}$. The movements according to vectors $\overline{GG'}$, $\overline{II'}$ and $\overline{MM'}$ are given to the clamping system 89 by a hollow lever 91 (see FIGS. 9 and 12) which supports clamping system 89 at one end, and is slidably supported by a sliding block 92 positioned to slide inside the slit 93 of said lever. Lever 91 is connected at its other end by means of a pin 96 to a driving lever 94 which is fulcrumed on a shaft 95 supported by the box 86. Lever 94 presents a roller 97 pressed by a spring 98 against a driving cam 99 keyed on a shaft 100 which is operated by the already cited driving shaft 33 coming out of the driving device 4. The movements according to vectors $\overline{HH'}$ and $\overline{LL'}$ are on the contrary given to the clamping system 89 by the hollow lever 91 operated by a L-shaped driving lever 101 which is fulcrumed on the pin 102. The other end of lever 101 is pivotally connected to the sliding block 92 and is operated by a driving cam 105 keyed on the shaft 100. The contact between the lever and the cam is assured by a roller 103 and a spring 104. The clamping system 89 is opened in its rest position, i.e. the clamping pliers 123 and 124 are removed from each other, since the head roller 106 is hung to a supporting hook 107 horizontally protruding out of the box 86 of the device 2 in an adjustable way, which hook overcomes the action of spring 108 tending to keep said clamping pliers 123 and 124 closed to each other.

When the reed 47 has beated the weft thread 15 into the relevant shed, the clamping system 89 begins a forward movement according to vector $\overline{GG'}$ for grasping the weft end 15*b* and a downward movement according to vector $\overline{HH'}$ since roller 106 is no more hung to the supporting hook 107 and spring 108 may hence explicate its action closing the pliers 123 and 124 so that said weft end 15*b* is grasped. At the same time shears 109 cut the exceeding part of the weft end 15*b*, which is sucked by the suction hose 88 and conveyed through the flexible pipe 110 into the container 111 (see FIG. 1).

The movement of the moving blade 113 of shears 109 (see specifically FIG. 13) is obtained by means of the lever 112 connected through an adjustable stay rod 116 to a bell-crank lever 114 which is fulcrumed on the pin 115 supported by box 86 and it is operated by a cam 119 keyed on the shaft 120 rotated by the already cited driving shaft 33 coming out of the driving device 4, the contact between the cam and the bell-crank lever being assured by a roller 117 and a spring 118.

Figure 9:
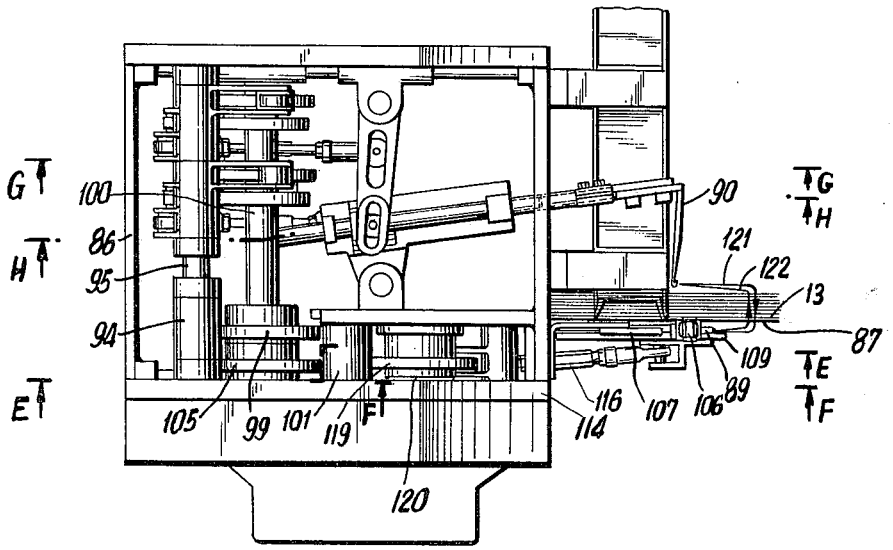
FIG. 9 is a sectioned top view of the device of FIG. 8, wherein there are also shown the movements of the right hooked needle.

In FIG. 9 there is shown by thick line 121 and by thin line 122 the whole movement of the hooked needle 90.

Figure 6:
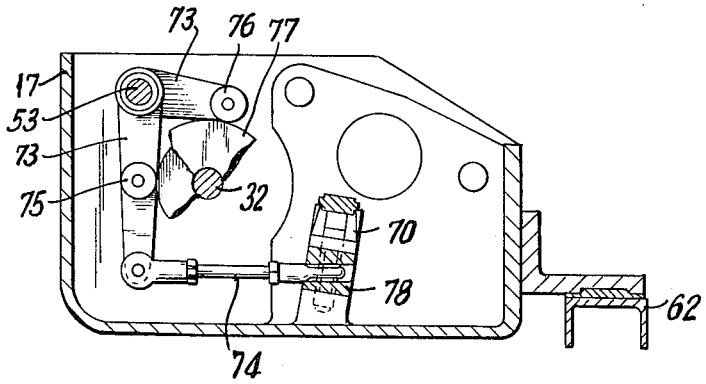
FIG. 6 is a sectioned front view made according to arrows CC on FIG. 3 of the device operating the left hooked needle according to invention.
Figure 7:
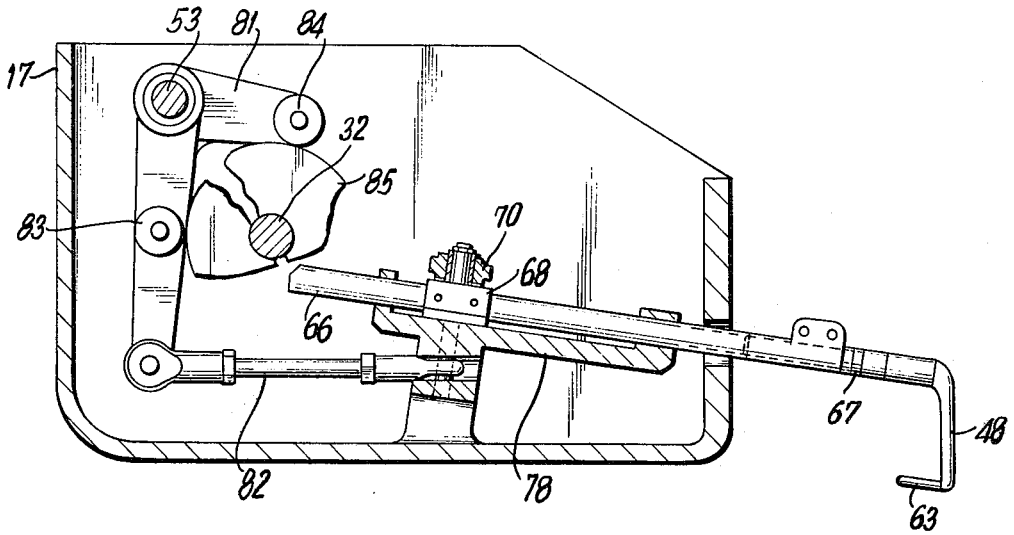
FIG. 7 is also a sectioned front view of the device operating the left hooked needle, taken however according to arrows DD on FIG. 3.
Figure 13:
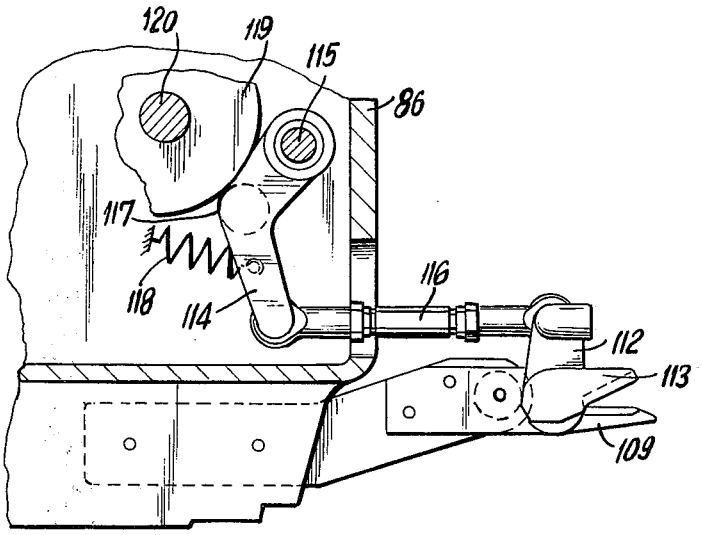
FIG. 13 is a sectioned front view made according to arrows FF on FIG. 9 of the device operating the shears according to the invention.
Figure 8:
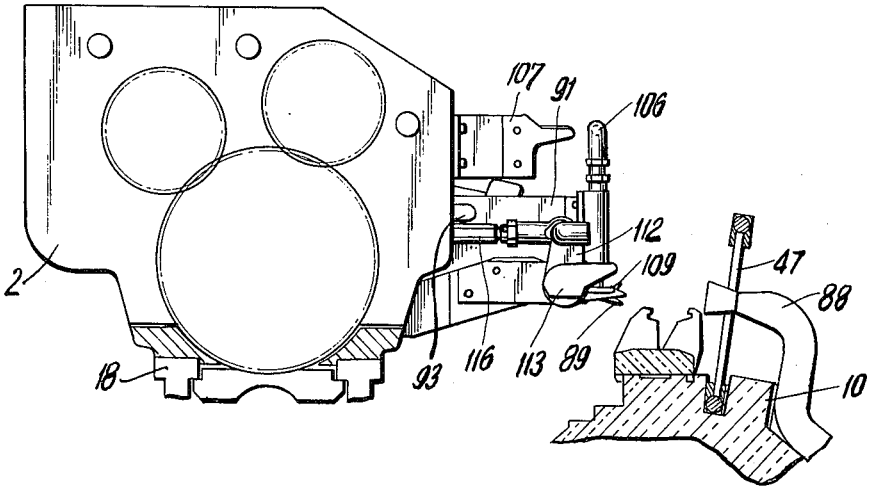
FIG. 8 shows in a front view made according to arrows NN on FIG. 1 the device according to the invention for folding into the shed the ends of the weft threads on the right-hand side of the formed fabric.
Figure 10:
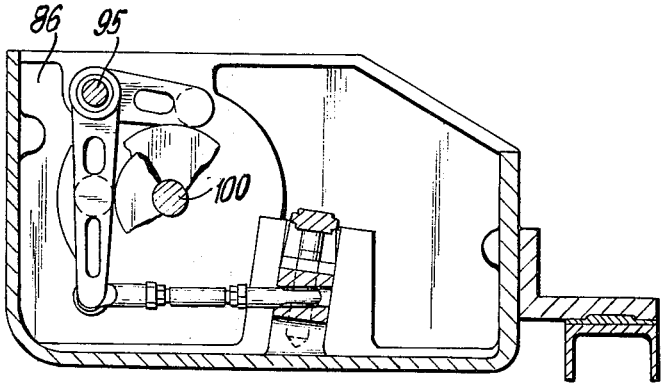
FIG. 10 is a sectioned front view made according to arrows GG on FIG. 9 of the device operating the right hooked needle, said Figure being like FIG. 6.
Figure 11:
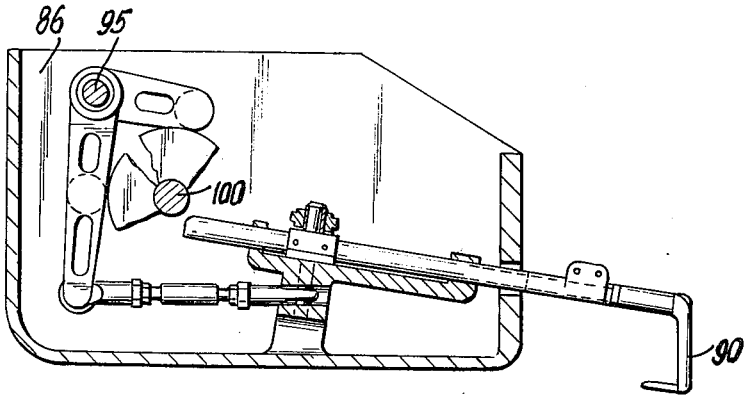
FIG. 11 is also a sectioned front view of the device operating the right hooked needle, taken however according to arrows HH on FIG. 9, said Figure being like FIG. 7.

This movement and the mechanisms shown in FIGS. 10 and 11, which carry out said movement, are symmetrically equal to the movement shown in FIG. 3 by the thick line 64 and by the thin line 65 and to the relevant mechanisms shown in FIGS. 6 and 7 respectively and therefore they are not further described herein.

Now, while the hooked needle 90 performs the above said movement according to lines 121 and 122 during the insertion into the next shed of a new weft thread 14, the clamping system 89 performs the forward and upward movements according to vectors $\overline{II'}$ and $\overline{LL'}$ respectively (see FIG. 12) so that, as already said, the hooking of the weft end 15*b* to the hooked needle 90 is made very easy. Successively, the clamping system 89, after the weft end 15*b* to be folded has been grasped by the hooked needle 90 which is folding it into the said next shed of the new weft thread 14, returns to its starting position by performing the movement according to vector $\overline{MM'}$. The roller 106 leans then on the supporting hook 107 and the clamping system 89 is again in its opened rest condition, i.e. prepared for a next clamping of a new weft end to be folded.

What we claim is:

1. In a shuttleless loom having a continuous weft-supply mechanism, wherein the different weft threads are supplied by bobbins mounted outside the shed, said weft threads being presented by a weft selecting mechanism and remaining attached to the edge of the formed fabric to form a mingling of threads, means for cutting said weft threads only after they have been introduced into the shed by a thread carrier moving on the sley of the loom, wherein the movement comprises a device for folding both ends of a weft thread into the shed formed by the warp threads, said device having a first moveable pneumatic suction hose on one side of the loom, where the weft threads are attached to the fabric, for retaining the cut weft end of the thread extending from the fabric when said end is released from the mingling; first means operatively coupled to said hose for moving the hose in a plane perpendicular to the plane of the fabric and parallel to the warp threads to present the weft end adjacent the shed; a hooked needle; second means for moving said hooked needle in a plane inclined towards the sley relative to the plane of the fabric; means for coordinating the movements of said first and second moving means such that said cut weft thread end is engaged by said hooked needle and folded into the shed prior to the beating of the weft thread against the fabric fell; a second pneumatic suction hose on the opposite side of the loom for grasping and tensioning the second weft thread end brought through the shed by said carrier; a mechanical clamping means for grasping said second weft thread end after beat-up; third means for moving said clamping means in the plane perpendicular to the plane of the fabric and parallel to the warp threads to present the weft end adjacent the shed; said clamping means including means for cutting said second weft thread end at a pre-determined length; a second hooked needle; fourth means for moving said second hooked needle along a path symmetrical with the first hooked needle; and means for coordinating the movement of said third and fourth moving means such that said second hooked needle engages and folds second weft thread end into the next shed.

2. The device of claim 1, wherein said first mentioned coordinating means is operatively coupled to the pick repeat in said weft selecting mechanisms such that said one side weft thread ends are folded into the same sheds wherein the corresponding weft threads are inserted the next time, whereby said one side weft ends are formed into a bridle shaped selvage, and second mentioned coordinating means is adapted and arranged such that the opposite side weft threads are folded into the next shed.

3. The device of claim 1, wherein said first moving means provides said first pneumatic suction hose with a movement of rotation and translation in a plane perpendicular to the one of the fabric and parallel to the warp threads, said first moving means comprising frame means; a hollow lever supporting said hose at one end; a first drive lever pivotally attached at one end to said frame means and pivotally attached at its opposite end to the other end of said hollow lever, said hollow lever having a slit therein, a slide block slidably positioned in said slit; a second L-shaped driving lever pivotally attached to said frame means at one end and to said slide block at the other end, cam means for moving said first and second drive levers.

4. The device of claim 1, wherein said third moving means provides said clamping means with a movement of rotation and translation in a plane perpendicular to the one of the formed fabric and parallel to the warp threads, said third moving means comprising frame means; a hollow lever supporting said second pnuemated suction hose at one end; a first drive lever pivotally attached at one end to said frame means and pivotally attached at its opposite end to the other end of said hollow lever, said hollow lever having a slit therein, a slide block slidably positioned in said slit; a second L-shaped driving lever pivotally attached to said frame means at one end and to said slide block at the other end, cam means for moving said first and second drive levers.

5. The device of claim 1, wherein said second and fourth moving means provide said first and second hooked needles with symmetrical movements of rotation and translation in a plane inclined towards the sley as to the plane of the fabric, each said second and fourth moving means comprising: frame means; a control rod carrying the hooked needle at one end; a T-shaped horizontally disposed lever, said lever being pivotally mounted to said frame means at the end of its central stem, and slidably supporting said control rod in a downwardly inclined orientation towards the loom reed; a second horizontal lever pivotally mounted to said frame means at one end and defining a longitudinal groove at the opposite end; said control rod carrying a block thereon, said block being slidably received in said groove to couple said control rod to said second horizontal lever; and a stay rod pivotally coupled to the central portion of said second horizontal lever at one end; and cam means operatively coupled to the opposite end of said stay rod for operating said second and fourth moving means.

* * * * *

UNITED STATES PATENT AND TRADEMARK OFFICE

CERTIFICATE OF CORRECTION

PATENT NO. : 3,951,177
DATED : April 20, 1976
INVENTOR(S) : Nicola Santucci

It is certified that error appears in the above-identified patent and that said Letters Patent are hereby corrected as shown below:

First page, Under "[56]", Correct 3rd line to read:

--3,444,900 5/1969 Schaffer.....139/122 W--

Column 1, line 18, Delete "into the warp shed"

Column 2, line 12, Change "on" to read --On-- line 16, After "sley" insert a period --.-- and

Change "after" to read --After--

Column 3, line 39, After "stem" change the colon ":" to a semi-colon --;--

Column 4, line 5, After "device" insert --used--

Column 5, line 2, Delete "length" and insert --shed-- line 45, Before "crank" insert --bell- --

Column 8, line 22, Before "clamping" insert --the--

Signed and Sealed this

Eighth Day of February 1977

[SEAL]

*Attest:*

RUTH C. MASON
*Attesting Officer*

C. MARSHALL DANN
*Commissioner of Patents and Trademarks*